US005273459A

United States Patent [19]

Davis

[11] Patent Number: 5,273,459

[45] Date of Patent: Dec. 28, 1993

[54] CONNECTOR FEATURE FOR IMPROVED CONTACT WIPING

[75] Inventor: Wayne S. Davis, Harrisburg, Pa.

[73] Assignee: The Whitaker Corporation, Wilmington, Del.

[21] Appl. No.: 7,933

[22] Filed: Jan. 25, 1993

Related U.S. Application Data

[63] Continuation-in-part of Ser. No. 955,554, Oct. 1, 1992.

[51] Int. Cl.[5] ..... H01R 13/00

[52] U.S. Cl. ..... 439/607

[58] Field of Search ..... 439/607-610, 439/686-690

[56] References Cited

U.S. PATENT DOCUMENTS 3,760,335 9/1973 Roberts ..... 339/99 R
4,619,494 10/1986 Noorily et al. ..... 439/607
4,641,902 2/1987 Fusseleman ..... 439/607
4,682,836 7/1987 Noorily et al. ..... 439/607
5,073,130 12/1991 Nakamura ..... 439/607
5,158,481 10/1992 Frantz ..... 439/607

*Primary Examiner*—Joseph H. McGlynn

[57] ABSTRACT

A shielded electrical connector comprising: a terminal support block (41), contact terminals (51) supported on the block (41) for connection to wires (21), a rear bumper (43) bridging across the block (41) and extending laterally beyond the wires (21), a conductive front shell (6) encircling the block (41), conductive backshells (12, 14) enveloping the block (41), pushing arms (15) on at least one of the backshells (12,14) engaging the bumper (43) and urging a mating end of the block (41) to a most forward position relative to a front mating end of the front shell (6), and shifting of the block (41) rearwardly is resisted to promote contact wiping during mating connection of the connector (19) with another, mating connector.

13 Claims, 6 Drawing Sheets

CONNECTOR FEATURE FOR IMPROVED CONTACT WIPING

CROSS REFERENCE TO PENDING APPLICATION

The present application is a continuation in part of application Ser. No. 07/955,554, filed Oct. 1, 1992 (15319).

FIELD OF THE INVENTION

The invention pertains to a shielded electrical connector with electrical contacts, which promotes contact wiping during mating connection of the connector with another electrical connector.

BACKGROUND OF THE INVENTION

There is disclosed in U.S. Pat. No. 5,158,481, a shielded electrical connector comprising; a terminal support block encircled by a housing with a mating end, contact terminals supported on the block for connection to conductors, and shielding for the connector comprising; a front shell on the housing, a mating end on the front shell encircling the terminal support block, and conductive backshells enveloping the block.

The backshells and front shell are assembled by hooks passing through slots in the front shell. Compression beams near the hooks pressed against the front shell to establish electrical continuity between the front shell and the backshells.

The components, for example, the terminal support block and the housing and the front shell are separate components, manufactured with dimensions that vary within a permitted range of dimensional tolerances. These tolerances allow the components to interfit when combined together in a connector. These tolerances accumulate when the components are combined, and allow the components to shift their positions relative to one another in an assembled connector. Shifting of the components is especially detrimental when the connector undergoes mating connection with another, mating electrical connector. Such shifting, which occurs during mating connection, tends to move the terminal support block rearwardly with respect to the mating ends of both the housing and the front shell. The contact terminals supported on the block move rearwardly with the block during mating connection. Rearward movement of the contact terminals is not desired during mating connection, since rearward movement of the contact terminals tends to disconnect the connector from another, mating electrical connector. Furthermore, during mating connection, the contact terminals undergo desired contact wiping to dislodge nonconductive oxides and other contaminants that would contribute to an undesired voltage drop across the surfaces of the contact terminals. The contact wiping occurs when the contacts of the connector stroke against mating contacts of another, mating electrical connector, as the connectors undergo mating connection. The stroke is reduced when the contact terminals move rearwardly. Consequently, the contact wiping is reduced when the terminals move rearwardly due to shifting of the components.

SUMMARY OF THE INVENTION

According to a feature of the invention, components of an electrical connector are assembled in such a manner to resist shifting of the components when the electrical connector undergoes mating connection with another, mating electrical connector.

According to another feature of the invention, components of an electrical connector that are constructed with dimensions that are within a range of permitted dimensional tolerances, are assembled in such a manner that the components will attain predicted positions relative to a mating end of the connector.

According to another separate feature of the invention, one of the backshells pushes against the terminal block, and urges the terminal block forwardly, such that a mating end of the terminal block is accurately positioned with the mating end of the front shell.

DESCRIPTION OF THE DRAWINGS

An embodiment of the invention will now be described, by way of example, with reference to the accompanying drawings, according to which.

DETAILED DESCRIPTION

Figure 1:
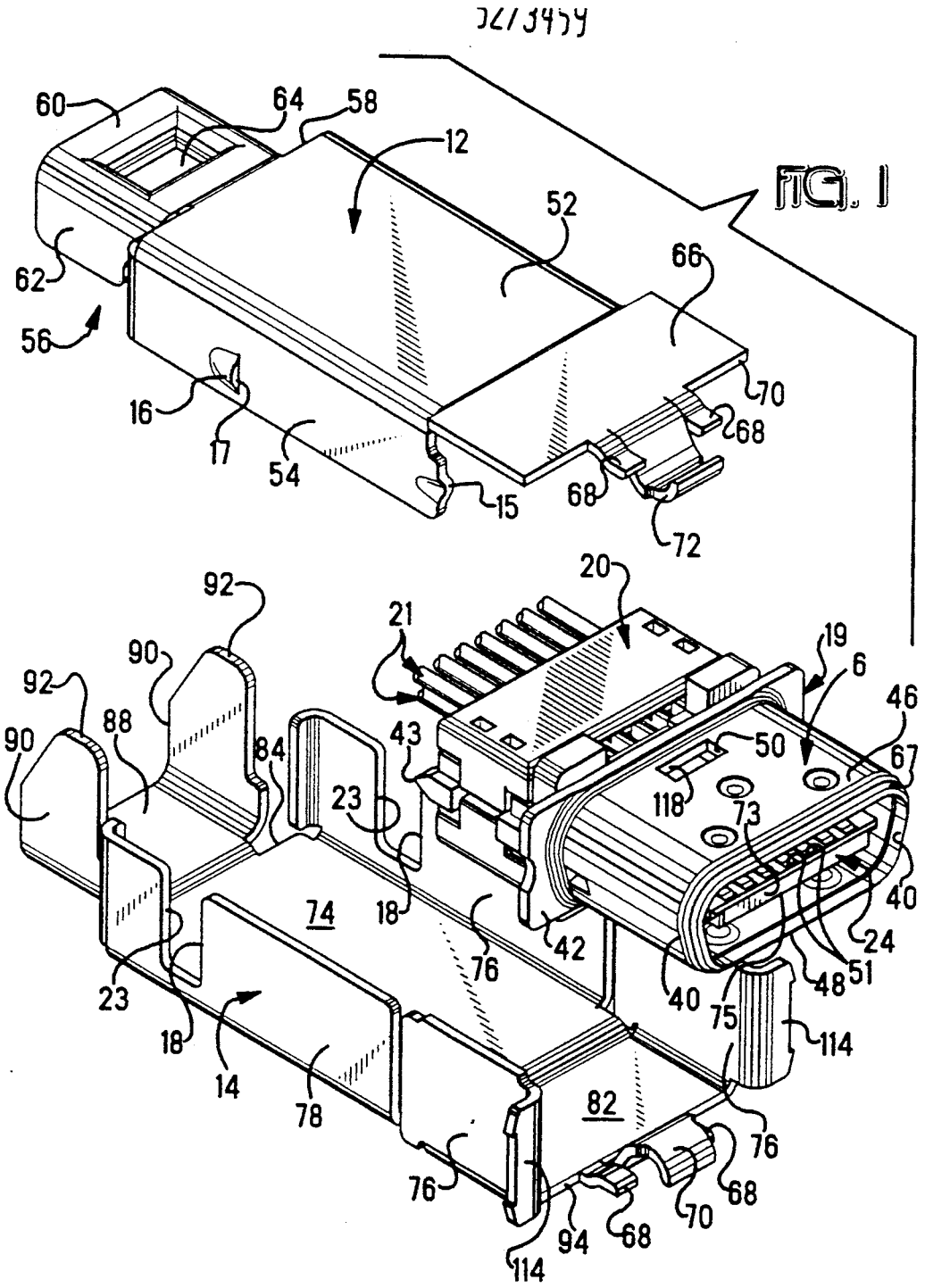
FIG. 1 is a perspective view of a shielded electrical connector with shielding parts separated from one another.
Figure 2:
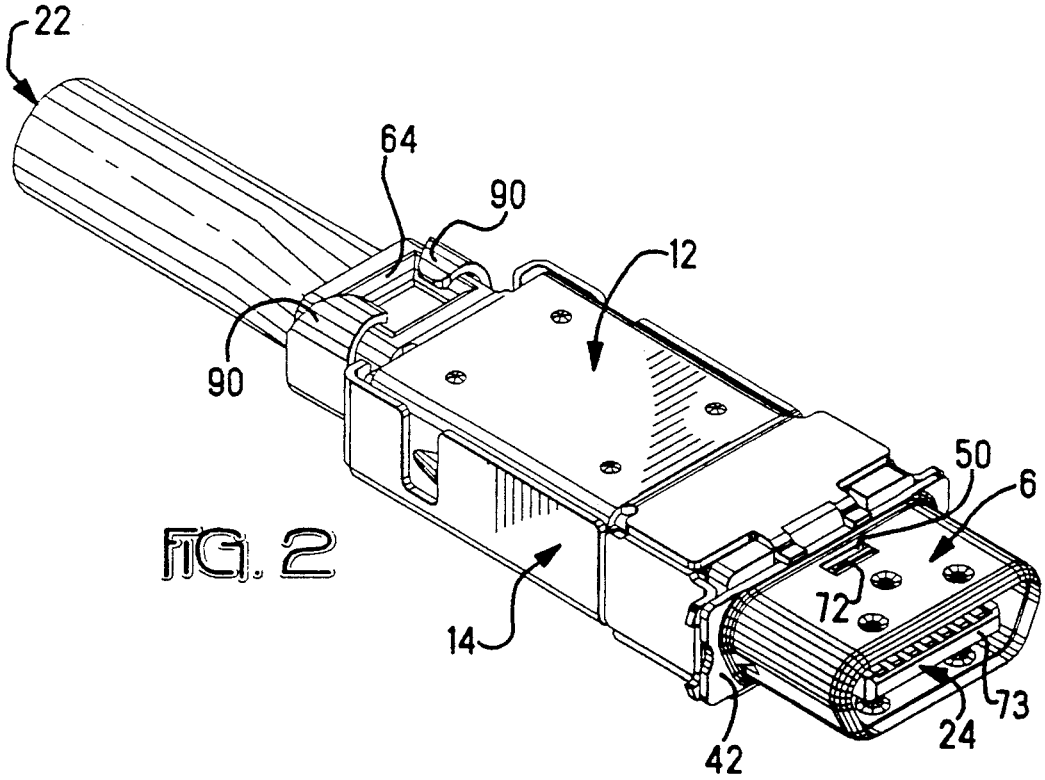
FIG. 2 is a perspective view of the connector shown in FIG. 1.

With reference to FIG. 1, a shielded plug type connector 19 comprises an insulative cable terminating section 20 for terminating conductors in the form of insulated wires 21 of a shielded multiple wire cable 22, FIG. 2, and an insulative plug connector section 24 projecting forwardly for mating with a shielded receptacle type connector, not shown. The plug connector section 24 includes a forwardly protruding terminal support block 41 supporting multiple contact terminals 51 having wire terminating portions 55, FIGS. 3 and 4, for connection to the wires 21.

Conductive electrical shielding is provided by a unitary drawn metal front shell 6 and an upper metal backshell 12 and a lower metal backshell 14. The shell 6 defines a cavity encircled by an upper wall 46 and a lower wall 48 and sidewalls 40 that are angled toward each other. Laterally extending slots 50 are provided in the walls 46 and 48 adjacent to a back lip providing a strip shaped bearing member 118 bridging across the back of the slots 50.

The backshell 12 is of unitary construction stamped and formed from sheet metal. The backshell 12 comprises an upper wall 52 and depending sidewalls 54 providing an inverted channel. At a rear of the backshell 12, projecting from a rear wall 58, is an anchoring member 56 for the lower backshell 14. The anchoring member 56 comprises, an upper wall 60 and depending side walls 62 defining an inverted channel. A recess 64 is formed as a deep depression in the upper wall 60. A plate 66 is offset from the plane of the wall 52 and extends forwardly. A pair of forward extending tabs 68 project from a front edge 70 of the plate 66. A curved, pivot hook 72 projects from the forward edge 70 between the tabs 68.

Figure 3:
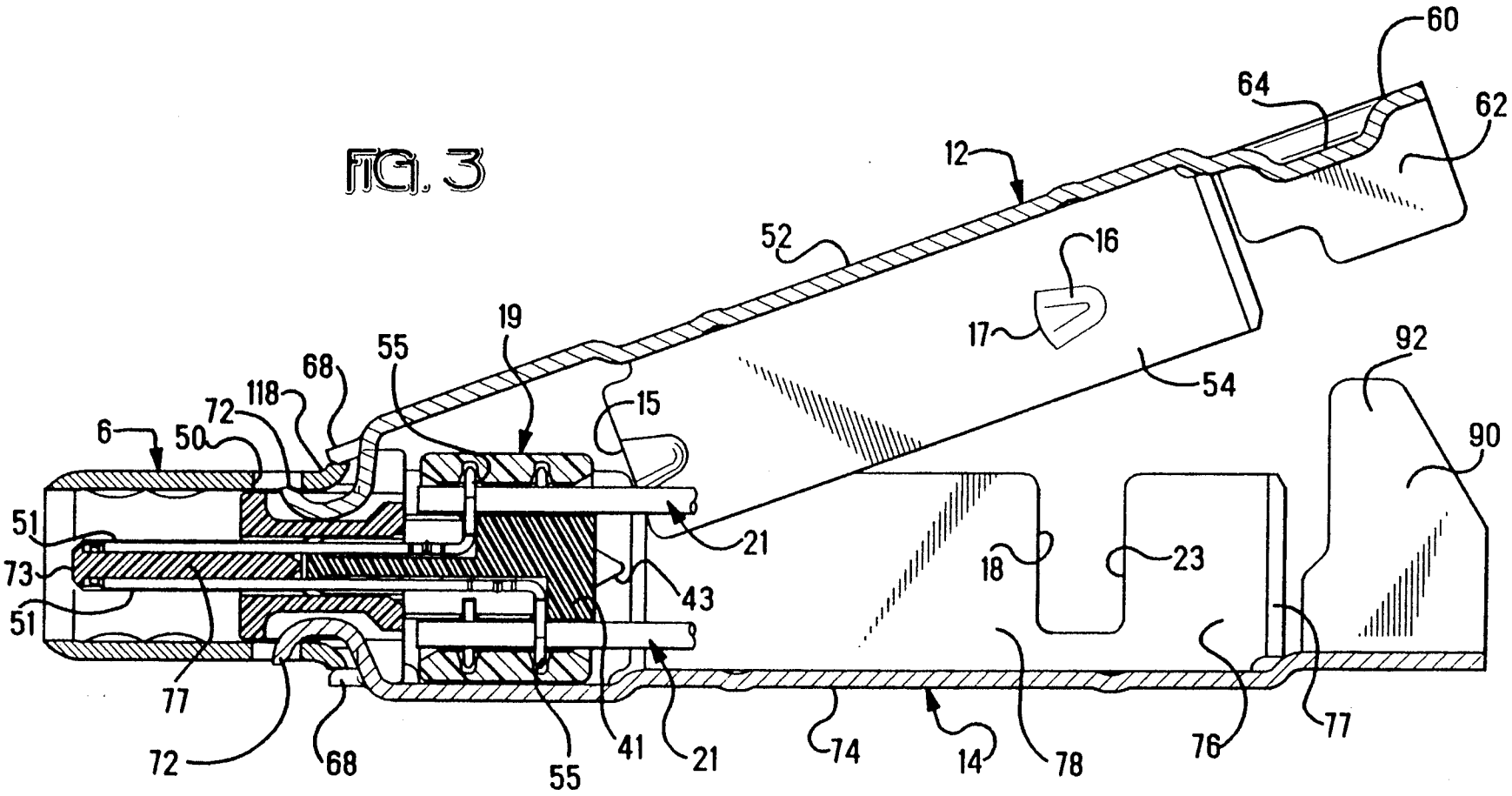
FIG. 3 is a longitudinal section view of the connector as shown in FIG. 1 with parts partially assembled.

The backshell 14 is of unitary construction stamped and formed from sheet metal. The backshell 14 comprises a lower wall 74 and upstanding sidewall sections 76, 78 defining a channel. Laterally outward turned flanges 77 are on front ends of the sidewall sections 76, 78. A plate 80 is offset from the plane of the wall 74 and extends forwardly. From a rear edge 84 of the backshell 14 projects a cable strain relief member 86 comprising a lower wall 88 and upstanding anchoring flanges 90 the tips of which are tapering portions 92. Forward of a front edge 94 project tabs 68 and a pivot hook 72, similar in construction as described in conjunction with the backshell 12. Further details of the backshell 12 and the backshell 14 are discussed in U.S. Pat. No. 5,158,481. Laterally projecting flanges 114 on the backshell 14 engaged behind a laterally projecting flange 42 on the rear of the drawn front shell 6. Further details of the front shell 6 and of the connector 19 are disclosed in U.S. Application Ser. No. 955,554, filed Oct. 1, 1992 (15319). With reference to FIG. 3, the backshell 14 is hooked and attached to the front shell 6 and envelops the connector 41. The backshell 12 is hooked to the front shell 6 and is pivoted toward the backshell 14 to envelop the connector 19.

A set of rear pushing arms 16 juts laterally outward from both sidewalls 54. The pushing arms 16 are fabricated by indenting the sidewalls 54 by punching outward the sidewalls 54 to provide sheared front edges 17 facing forwardly and engaging against rearward facing edges 18 of the backshell 14. The edges 18 are formed at the edges of vertical slots 23 having open ends to receive the pushing arms 16 when the backshell 12 is pivoted toward the backshell 14. Further, the pushing arms 16 against the edges 18 resist insertion forces arising from mating connection of the connector 19 with a mating electrical connector, not shown. Following assembly of the backshells 12 and 14, the anchoring flanges 90 are inwardly bent to be wrapped over the anchoring member 56 and the cable 22, FIG. 2, and enter the recess 64 to secure together the backshells 12 and 14, and to grip the cable 22 and provide a cable strain relief. The backshells 12 and 14 are connected together by the anchoring flanges 90 and the anchoring member 56.

Figure 5:
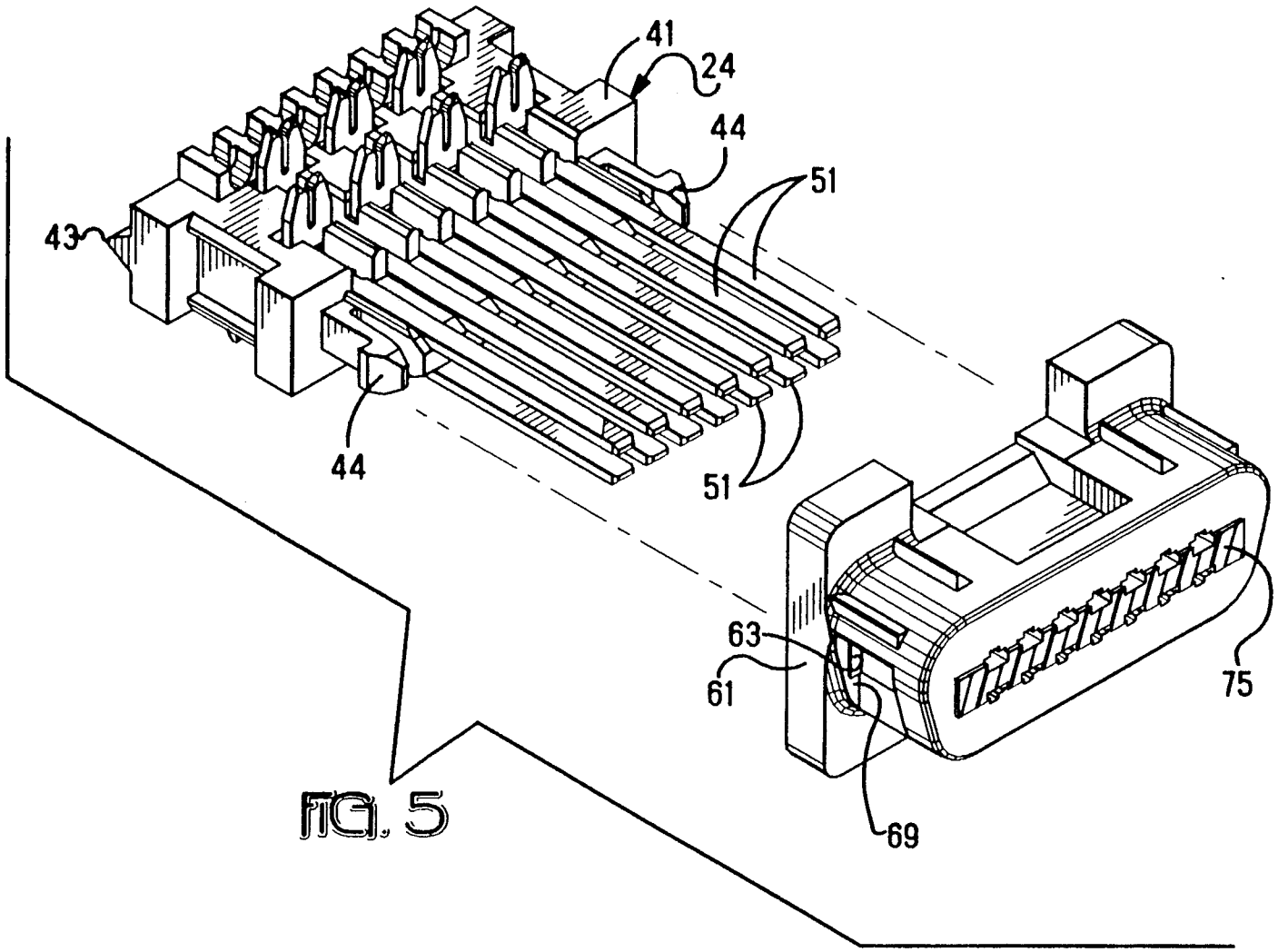
FIG. 5 is a perspective view of a terminal support block and a housing of the connector shown in FIG. 1.

With reference to FIG. 5, the terminal support block 41 is a separate component, as are each of the front shell 6 and an insulative housing 61 shaped to be received in, and to be surrounded by, the front shell 6. The housing 61 has a rear facing cavity 71, FIG. 6, to receive a front end of the terminal support block 41. The contact terminals 51 project forwardly from the front end of the terminal support block 41 and are supported against a tongue 75 on the housing 61. Resilient clamping fingers, one being shown at 44, formed unitary with and on the front of the terminal support block 41 hooks onto undercut recesses 63, one being shown, in the housing 61 to prevent separation of the terminal support block 41 and the housing 61.

Figure 6:
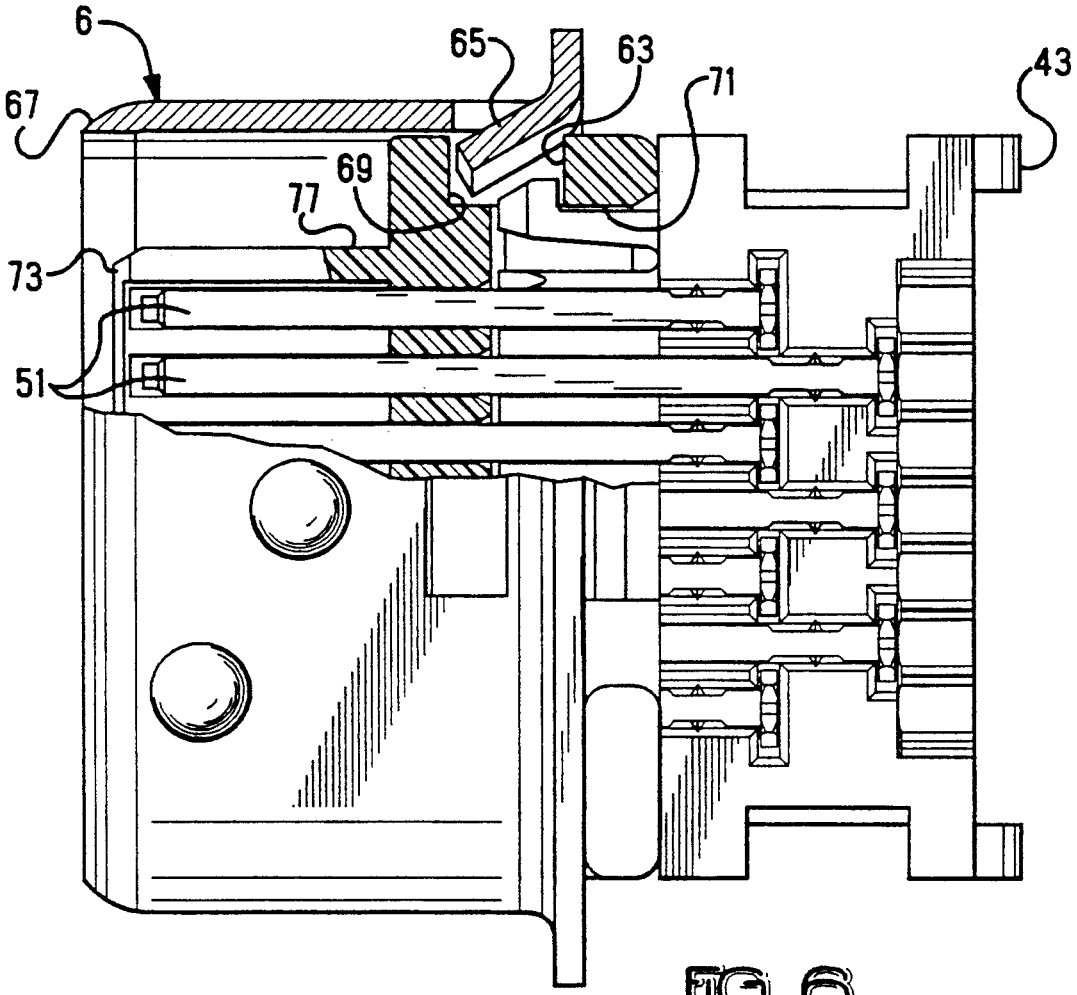
FIG. 6 is a view partially in section of a portion of the connector shown in FIG. 1.

With reference to FIG. 6, resilient fingers, one being shown at 65, on the front shell 6 projects obliquely toward a front mating end 67 of the front shell 6, and registers in undercut recesses, one shown at 69, in the housing 61 to prevent removal of the front shell 6 from the housing 61. A mating end 73 of the housing 61 is encircled by the mating end 67 of the front shell 6.

The front shell 6, the terminal support block 41 and the housing 61 are manufactured with dimensions that are within a range of permitted dimensional tolerances. These tolerances allow the components to interfit when they are assembled or combined together in a connector. These tolerances become cumulative when the components are combined, and allow the components to shift their positions relative to one another in an assembled connector. For example, with reference to FIG. 6, the tolerances permit the fingers 61 to shift, front to rear, in the recesses 63. The tolerances permit the fingers 65 to shift, front to rear, within the recesses 69. Thus, the front shell 6, the housing 61 and the terminal support block 41 are components that tend to shift their positions undesireably relative to one another in an assembled connector 19.

Shifting of the components is especially detrimental when the connector 19 undergoes mating connection with another, mating electrical connector, not shown. Such shifting, which occurs during mating connection, tends to move the terminal support block 41 rearwardly with respect to the mating ends 67 and of both the housing 61 and the front shell 6. The contact terminals 51 supported on the block 41 move rearwardly with the block 41 during mating connection. Rearward movement of the contact terminals 51 is not desired during mating connection, since rearward movement of the contact terminals 51 tends to disconnect the connector 19 from another, mating electrical connector, not shown. Furthermore, during mating connection, the contact terminals 51 undergo desired contact wiping to dislodge nonconductive oxides and other contaminants on the surfaces of the contact terminals 51 that would contribute to an undesired voltage drop across the surfaces of the contact terminals 51. The contact wiping occurs when the contact terminals 51 stroke against mating contacts of another, mating electrical connector, during mating connection. The stroke is reduced when the contact terminals 51 move rearwardly. Consequently, the contact wiping is reduced when the contact terminals 51 move rearwardly due to shifting of the components.

Figure 4:
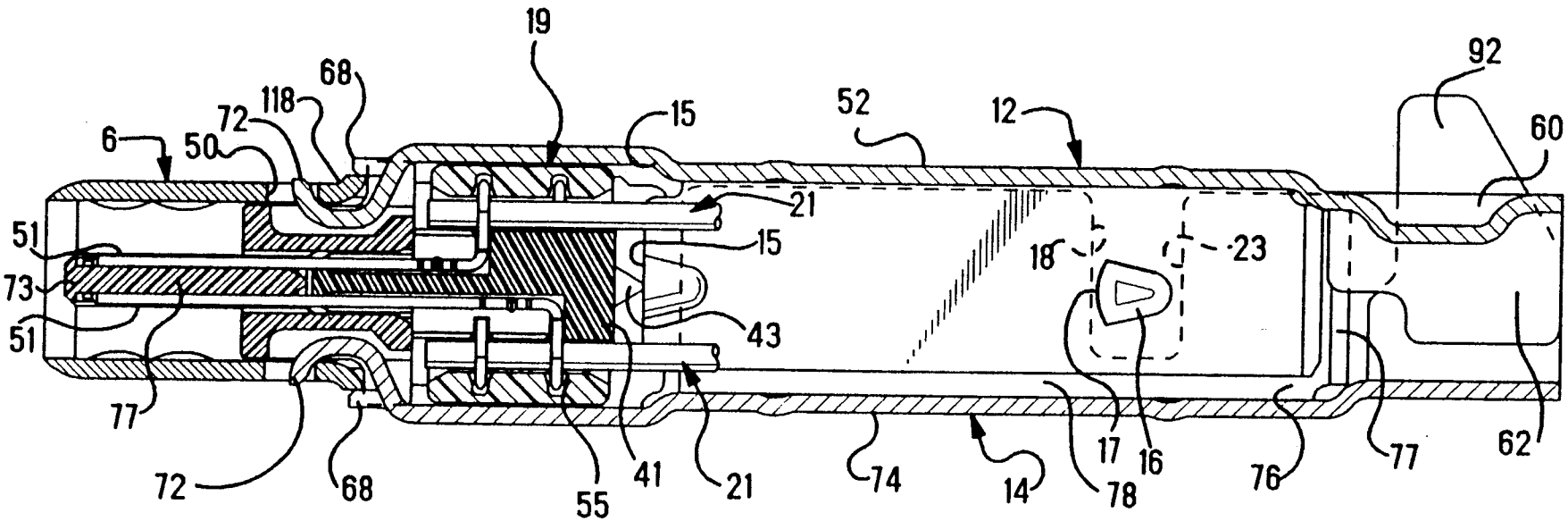
FIG. 4 is a view similar to FIG. 3 with the parts assembled together.

With reference to FIGS. 1, 3 and 4, a rear projecting bumper 43 bridges laterally and extends across a rear end of the terminal support block 41. The bumper 43 is constructed as two disconnected parts adjacent edges of the terminal block 41. The bumper 43 can also be one piece extending entirely along the support block 41. The bumper 43 can be made integral with the support block 41, for example, by molding a dielectric material. The bumper 43 juts outwardly in opposite lateral directions from the wires 21 that extend over the bumper 43. The bumper 43 has a tapered rear edge intersecting a central axis of the terminal support block 41 of the connector 19.

The back shell 12 comprises a set of front pushing arms 15 on front facing edges on respective sidewalls 54. For example, the pushing arms 15 are fabricated by indenting the front facing edges to stiffen them. The pushing arms 15 engage the tapered edge on the rear facing bumper 43, where the bumper 43 juts out laterally beyond the wires 21, urging the connector 19 forwardly with respect to the backshell 12 and with respect to the front shell 6. At least one of the pushing arms 15 exerts pushing forces axially and through a middle of the connector 19. A high mechanical advantage is achieved when pivoting the backshell 12 by hand about the pivot hook 72, because the length of the backshell 12 to the pivot hook 72 is a multiple of the shorter distance between the pushing arms 15 and the pivot hook 72. Urging the connector 19 forwardly compensates for variations in cumulative tolerances separating the assembled components, by urging the terminal support block 41 to shift to its most forward position relative to the mating end of the front shell 6, and by urging the terminal support block 41 to impinge against the housing 61 to urge the housing 61 to shift to its most forward position relative to the mating end of the front shell 6. The pushing arms 15 against the bumper 43 resist shifting of the components rearwardly from their most forward positions. Accordingly, the components of the electrical connector 19 are constructed with dimensions that are within a range of permitted dimensional tolerances, and are assembled in such a manner that mating ends of the components will attain predicted positions relative to a mating end of the connector 19.

The pushing arms 15 against the bumper 43 resist insertion forces arising from mating connection of the connector 19 with a mating type connector, not shown. According to this feature of the invention, the components of the electrical connector 19 are assembled in such a manner to resist shifting of the components when the electrical connector 19 undergoes mating connection with another, mating electrical connector, not shown.

An advantage of the invention resides in a backshell 12 that urges components of the connector 19 forwardly to resist insertion forces during mating connection with another, mating connector. Another advantage of the invention resides in an electrical connector 19 constructed from separate components that assure mating ends of the components attain predicted positions relative to a mating end of the connector 19.

Other embodiments, objects and advantages of the invention are intended to be covered by the spirit and scope of the appended claims.

I claim:

1. A shielded electrical connector comprising: a terminal support block, contact terminals supported on the block for connection to conductors, a rear bumper bridging across the block and extending laterally beyond the wires, conductive backshells enveloping the block, pushing arms on at least one of the backshells engaging the bumper and urging the block forwardly of the one backshell, and urging a front mating end of the block to a most forward position relative to a front mating end of a conductive front shell encircling the block and being connected to the one backshell.

2. A shielded electrical connector as recited in claim 1, comprising: a housing encircling the block, the block being connected to the housing, and the pushing arms engaging the bumper and urging the block to impinge against the housing and to urge a front mating end of the housing to a most forward position relative to the front mating end of the front shell.

3. A shielded electrical connector as recited in claim 1, comprising: the pushing arms being provided by indented front facing edges on one of the backshells.

4. A shielded electrical connector as recited in claim 1, comprising: the bumper comprising a portion of the block intersecting a central axis of the block.

5. A shielded electrical connector as recited in claim 1, comprising: the bumper having a rear facing tapered edge engaged by the pusher arms.

6. A shielded electrical connector as recited in claim 1, comprising: portions of the backshells being secured together and providing a cable strain relief for wires being connected to the contact terminals.

7. A shielded electrical connector as recited in claim 1, comprising: a set of pushing arms on one of the backshells engaged against rear facing edges of a second one of the backshells, a flange on the second one of the backshells urged forwardly by the set of pushing arms forwardly against a rear of a flange on the front shell.

8. A shielded electrical connector as recited in claim 7, comprising: slots on the second backshell having open ends to receive the second set of pushing arms when the first backshell is pivoted toward the second backshell.

9. A shielded electrical connector as recited in claim 8, comprising: rear facing edges of the slots being engaged by the second set of pushing arms.

10. A shielded electrical connector comprising: a terminal support block, a conductive front shell encircling a mating end of the block, contact terminals supported on the block for connection to wires, conductive backshells enveloping the block, a set of pushing arms on one of the backshells urged forwardly against the block urging the block to a most forward position relative to a mating front end of the conductive front shell, and the one backshell being connected to the front shell.

11. A shielded electrical connector comprising: a terminal support block, contact terminals supported on the block for connection to wires, and shielding for the connector comprising; a mating end on a front shell encircling a mating end of the terminal support block, and conductive backshells enveloping the block, whereby, to prevent shifting of the block rearwardly relative to the front shell, one of the backshells pushes against the block urging the block to a most forward position relative to the front shell, and the backshells being connected together.

12. A shielded electrical connector as recited in claim 11 wherein said one of the backshells is pivoted to push against the terminal support block.

13. A shielded electrical connector as recited in claim 12 wherein a pushing arm on said one of the backshells pushes against the terminal support block, and the length of the said backshell is a multiple of the distance between the pushing arm and a pivot for said backshell.

* * * * *